US005587790A

United States Patent [19]

Nagashima

[11] Patent Number: 5,587,790

[45] Date of Patent: Dec. 24, 1996

[54] LIGHT SCATTERING TYPE SMOKE DETECTOR HAVING AN IMPROVED ZERO-POINT LEVEL

[75] Inventor: Tetsuya Nagashima, Tokyo, Japan

[73] Assignee: Hochiki Corporation, Tokyo, Japan

[21] Appl. No.: 300,193

[22] Filed: Sep. 2, 1994

[30] Foreign Application Priority Data

| | | | |
|---|---|---|---|
| Sep. 7, 1993 | [JP] | Japan | 5-221548 |
| Sep. 7, 1993 | [JP] | Japan | 5-221549 |
| Sep. 7, 1993 | [JP] | Japan | 5-221550 |
| Sep. 7, 1993 | [JP] | Japan | 5-221551 |

[51] Int. Cl.[6] ..... G01N 21/00; G01N 21/49; G08B 17/10

[52] U.S. Cl. ..... 356/338; 356/340; 250/574; 340/630

[58] Field of Search ..... 340/630; 250/574; 356/337–339, 340

[56] References Cited

U.S. PATENT DOCUMENTS

| | | | |
|---|---|---|---|
| 4,359,556 | 9/1985 | Dederich et al. | 340/515 |
| 4,851,819 | 7/1989 | Kawai et al. | 340/630 |
| 4,897,634 | 1/1990 | Sawa et al. | 340/630 |
| 5,021,677 | 6/1991 | Igarashi et al. | 340/630 |
| 5,302,837 | 4/1994 | Sawa et al. | 340/630 |

FOREIGN PATENT DOCUMENTS

| | | | |
|---|---|---|---|
| 0213878 | 3/1987 | European Pat. Off. . | |
| 52-10788 | 1/1977 | Japan . | |
| 53-65696 | 6/1978 | Japan . | |
| 02227800 | 9/1990 | Japan | 340/630 |
| 3296897 | 12/1991 | Japan | 340/630 |
| 05303697 | 11/1993 | Japan | 340/630 |
| 05303691 | 11/1993 | Japan | 340/630 |
| 06076182 | 3/1994 | Japan | 340/630 |
| 2000282 | 1/1979 | United Kingdom | 340/630 |
| 2270157 | 3/1994 | United Kingdom . | |
| 2277376 | 10/1994 | United Kingdom | 340/630 |

*Primary Examiner*—Frank Gonzalez
*Assistant Examiner*—Jason D. Eisenberg
*Attorney, Agent, or Firm*—Sughrue, Mion, Zinn, Macpeak & Seas

[57] ABSTRACT

A light scattering type smoke sensor of the present invention has a plurality of labyrinth members for facilitating an inflow of smoke entering from the outside, and for cutting off light entering from the outside; a plurality of smoke inlets each of which is formed by a space between paired ones of the labyrinth members being adjacent to each other; a smoke detecting chamber which is formed in a center portion by the labyrinth members; light emitting device for radiating light toward the smoke detecting chamber; and light receiving device for detecting light which is scattered by the smoke in the smoke detecting chamber, the light receiving device having an optical axis which intersects in the smoke detecting chamber an optical axis of the light emitting device at a scattering angle in the range of 60° to 80°, wherein one of the labyrinth members intersects the optical axis of the light emitting device, which has a reflecting face for reflecting light radiated from the light emitting device, the reflecting face reflecting the light in a direction opposite to the light receiving device.

28 Claims, 10 Drawing Sheets

$\theta 1 \lesssim 10°$ $60° \lesssim \theta 2 \lesssim 80°$ $\theta 3 \fallingdotseq 45°$

LIGHT SCATTERING TYPE SMOKE DETECTOR HAVING AN IMPROVED ZERO-POINT LEVEL

BACKGROUND OF THE INVENTION

1. Field of the Invention

The present invention relates to a light scattering type smoke sensor for sensing smoke by detecting light scattered by smoke.

2. Description of the Related Art

In a light scattering type smoke sensor of this kind, labyrinth members constitute a smoke detecting chamber which allows smoke to efficiently enter from the outside and cuts off light entering from the outside, and optical axes of light emitting and receiving sections are disposed in such a manner that their optical axes intersect each other in the smoke detecting chamber to detect light scattered by the smoke.

As a light emitting device constituting the light emitting section, such a conventional light scattering type smoke sensor uses an infrared LED (light emitting diode) having a relatively wide directional angle of 30° to 60°. Consequently, the scattering angle at which the optical axes of the light emitting and receiving sections intersect, and the shapes and reflection angles of the labyrinth members have to be designed so that the light receiving section is prevented from directly receiving light of the relatively wide directional angle from the infrared LED.

In the conventional light scattering type smoke sensor, the light emitting device has a relatively wide directional angle. When the sensor is constructed to reduce its thickness, therefore, a part of direct light from the light emitting device and light reflected by the labyrinth members enter the light receiving device, thereby increasing the zero-point level. This produces a problem in that such a sensor cannot be constructed in a thin form.

The zero-point level means an output of the light receiving device obtained when there is no smoke in the smoke detecting chamber. If the light receiving device easily receives reflected light when there is no smoke in the smoke detecting chamber, the zero-point level is naturally increased so as to deteriorate the S/N ratio and reliability.

If the light emitting section may be assembled by placing a lens or the like in front of the light emitting device in order to reduce the directional angle of the light emitting section to thin the sensor, the production cost of the light emitting section is increased and a positional error in assembly between the light emitting device and the lens causes the light beam to be deviated in direction so that the sensor has to be assembled in a highly accurate manner to impair the productivity thereof.

In a light scattering type smoke sensor of this kind, the light receiving section has to receive only light scattered by smoke. Namely, the positions, shapes and reflection angles of the labyrinth members have to be designed so that the light receiving section is prevented from receiving direct light from the light emitting section multi-reflected light which is reflected at a plurality of times by the labyrinth members. However, the conventional light scattering type smoke sensor is designed without paying sufficient consideration on this point, thereby producing a problem in that the zero-point level is increased.

Recently, in the view point of the interior of a room, external appearance of a device or the like, the demand for constructing a sensor of this kind in a thin form is increasing.

In the above-described conventional light scattering type smoke sensor, however, the light emitting device has a relatively wide directional angle. Even when the sensor is constructed so as to have a thin form, therefore, direct light from the light emitting device is vertically reflected by the ceiling and bottom faces of the smoke detecting chamber, and the reflected light and light which is again reflected by these faces and the labyrinth members enter the light receiving device to increase the zero-point level. This produces a problem in that such a sensor cannot be constructing in a thin form. In addition, when the ceiling and bottom faces of the smoke detecting chamber are soiled, the zero-point level is further increased.

To comply with this, a configuration in which a throttle (opening) or a hood is disposed in front of the light emitting device may be employed. However, this configuration has problems in that all the light emitted from the light emitting device cannot effectively be used, and that the cost of the sensor is increased.

The configuration in which a throttle (opening) for reducing the projecting area of the light emitting device is disposed can prevent the zero-point level from being increased. In this configuration, however, all the light emitted from the light emitting device cannot effectively be used, with the result that the signal level due to light scattered by smoke is lowered.

SUMMARY OF THE INVENTION

The invention has been conducted in view of the above problems in the conventional light scattering device. It is an object of the invention to provide a light scattering type smoke sensor in which the zero-point level of the detection output of a light receiving section can be lowered to a level as low as possible, thereby enhancing the reliability. It is another object of the invention to provide a light scattering type smoke sensor in which, when the sensor is constructed in a thin form, the zero-point level of the detection output can be lowered, thereby improving the reliability.

In order to attain the objects, the light scattering type smoke sensor of the invention comprises: a plurality of labyrinth members for facilitating an inflow of smoke entering from the outside, and for cutting off light entering from the outside; a plurality of smoke inlets each of which is formed by a space between paired ones of the labyrinth members, the paired labyrinth members being adjacent to each other; a smoke detecting chamber which is formed in a center portion by the labyrinth members; a light emitting device for radiating light toward the smoke detecting chamber, the light emitting device having a half-value angle of substantially 10° or less; and a light receiving device for detecting light scattered by the smoke in the smoke detecting chamber, the light receiving device having an optical axis which intersects in the smoke detecting chamber an optical axis of the light emitting device at a scattering angle in the range of substantially 60° to 80°. One of the labyrinth members is a labyrinth member which intersects the optical axis of the light emitting device in a substantially center portion of the member, and which has a reflecting face for reflecting light radiated from the light emitting device, and the reflecting face reflects the light in a direction opposite to the light receiving device.

In the light scattering type smoke sensor, even when the accuracy of assembling the light emitting device and the light receiving device is low or the optical axis of the light emitting device is deviated, a part of direct light from the light emitting section and light reflected by the labyrinth members are prevented from entering the light receiving section. Therefore, the zero-point level can be lowered by such a simple structure.

Particularly, in order to attain another object of the present invention, a thinned light scattering type smoke sensor according to the invention a light scattering type smoke sensor comprises: a plurality of labyrinth members for facilitating an inflow of smoke entering from the outside, and for cutting off light entering from the outside; a plurality of smoke inlets each of which is formed by a space between paired ones of the labyrinth members, the paired labyrinth members being adjacent to each other; a smoke detecting chamber which is formed in a center portion by the labyrinth members; a light emitting device for radiating light toward the smoke detecting chamber; and a light receiving device for detecting light scattered by the smoke in the smoke detecting chamber, the light receiving device having an optical axis which intersects in the smoke detecting chamber an optical axis of the light emitting device. The projecting area of the light emitting device is within a height of a face of the labyrinth member which intersects the optical axis of the light emitting device. In this case, the projecting area means an area of the inside of the half value angle.

In the light scattering type smoke sensor, regarding the vertical direction, direct light from the light emitting device is reflected only by the labyrinth member intersecting the optical axis of the light emitting section, and is not reflected by the ceiling face and the bottom face of the smoke detecting chamber so that the zero-point level is lowered.

BRIEF DESCRIPTION OF THE DRAWINGS

In the accompanying drawings,

FIG. 2(*b*) is a diagram showing a plan view of the embodiment of the light scattering type smoke sensor according to the invention;

DETAILED DESCRIPTION OF THE PREFERRED EMBODIMENTS

Hereinafter, the detailed description of the preferred embodiments of the present invention will be described in detail with reference to the accompanying drawings.

Figure 1:
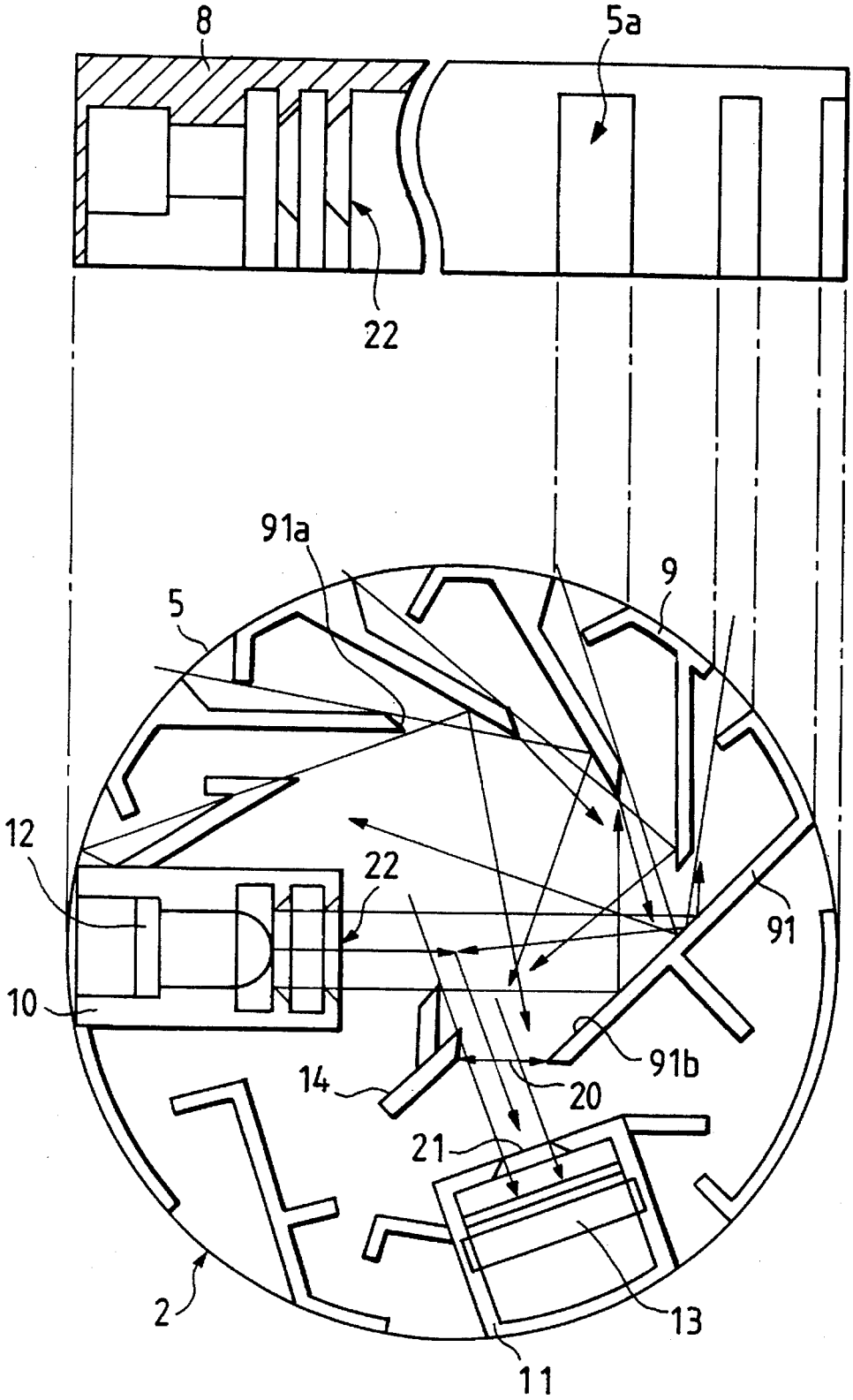
FIG. 1 is a diagram showing a plan view and a side section view of an embodiment of the light scattering type smoke sensor according to the invention.
Figure 2A:
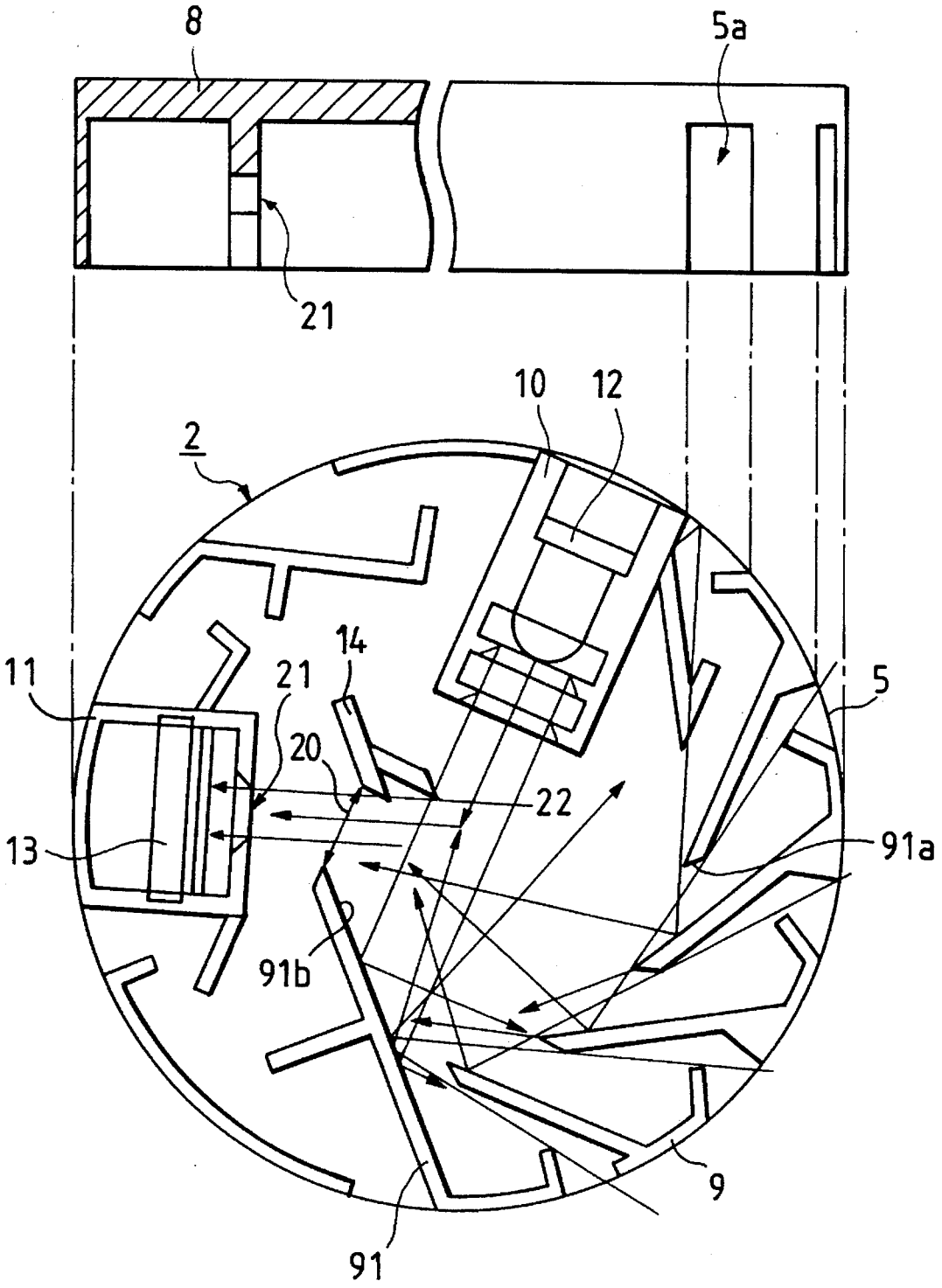
FIG. 2(*a*) is a diagram showing a plan view and a side section view of the embodiment of the light scattering type smoke sensor according to the invention.
Figure 2B:
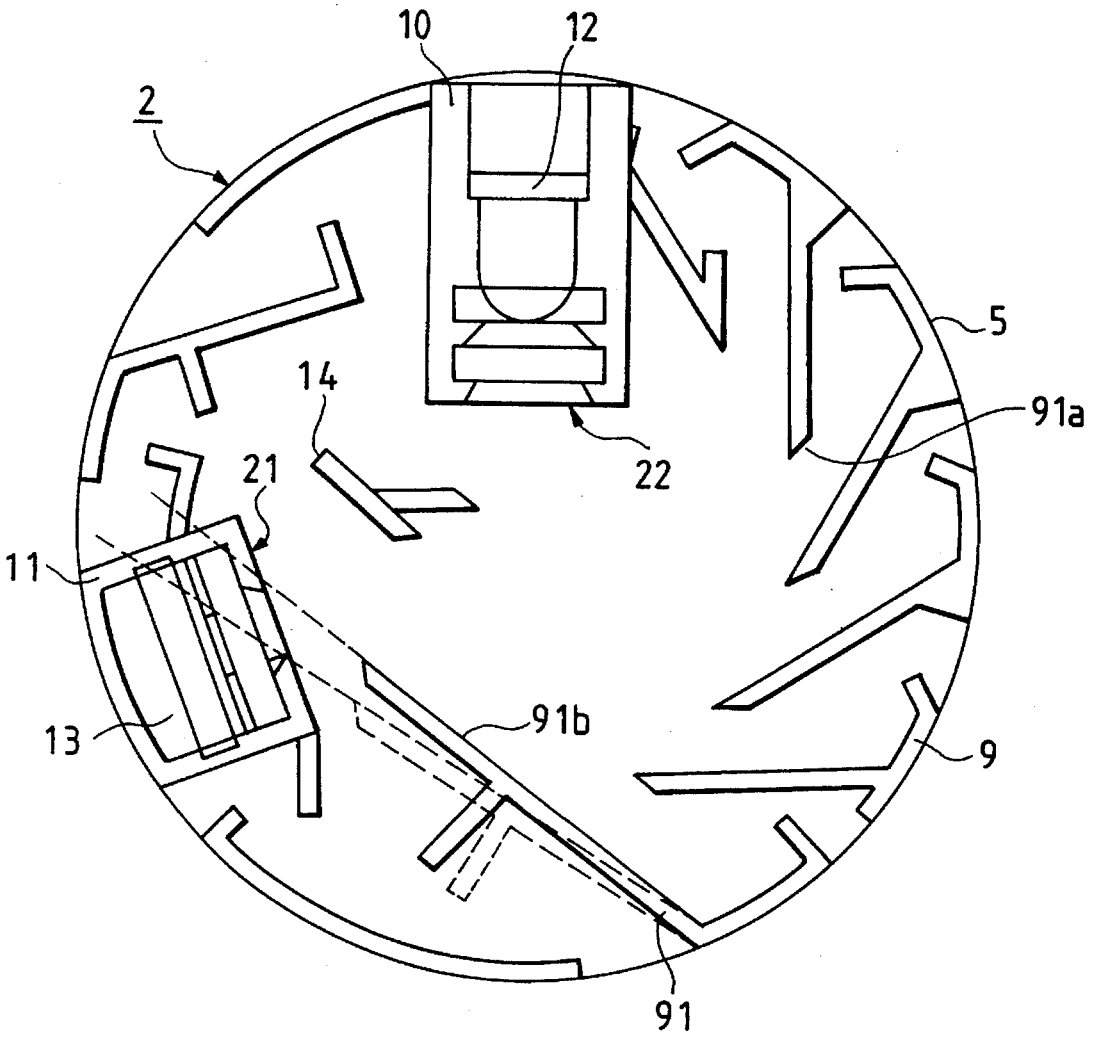

FIG. 1 shows a plan view of an embodiment of the light scattering type smoke sensor according to the invention, and a section view and an appearance of a holder for a light emitting device 12 as seen from the side, and FIG. 2 shows a section view and an appearance of a holder for a light receiving device 13 as seen from the side. In the side views shown in FIGS. 1 and 2, the light emitting device 12, the light receiving device 13, and an insect net 5 are not shown.

In FIGS. 1 and 2, a smoke detecting section body 2 is formed in a substantially cylindrical shape, and an upper wall 8 is attached to the ceiling. On the upper wall 8, a plurality of labyrinth members 9 are formed in a standing manner so that a smoke detecting chamber is formed in an area surrounded by the labyrinth members 9. The labyrinth members 9 are formed in such a manner they facilitate the inflow of smoke from the outside, and cut off light entering from the outside. Smoke inlets 5*a* formed by spaces between adjacent labyrinth members 9 are covered by an insect net 5 surrounding the labyrinth members so that insects are prevented from invading the smoke detecting chamber and scattering light. An opening of the bottom (which is opposite to the upper wall 8) of the smoke detecting section body 2 is covered by a cover which is not shown.

On the upper wall 8, moreover, holders 10 and 11, and a light shielding plate 14 are disposed in a standing manner. The holders 10 and 11 are formed as recess portions in which the light emitting device 12 and the light receiving device 13 for detecting smoke are respectively accommodated in such a manner that optical axes of the light emitting device 12 and the light receiving device 13 intersect each other at the center of the smoke detecting chamber constituted by the labyrinth members 9. The light shielding plate 14 prevents light radiated by the light emitting device 12 from directly reaching the light receiving device 13. The holders 10 and 11 are respectively provided with windows 22 and 21 for restricting their viewing fields so that the light receiving device 13 does not directly receive light emitted by the light emitting device 12. The light emitting device 12 and the holder 10 having the window 22 constitute a light emitting section for detecting smoke, and the light receiving device 13 and the holder 11 having the window 21 constitute a light receiving section for detecting smoke.

Figure 3:
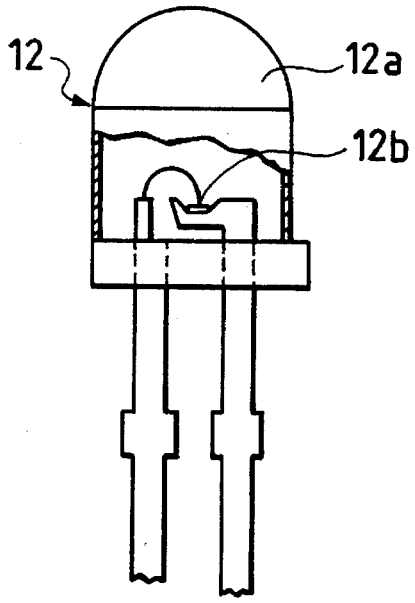
FIG. 3 is a diagram showing a light emitting device used in the light scattering type smoke sensor according to the invention.
Figure 4:
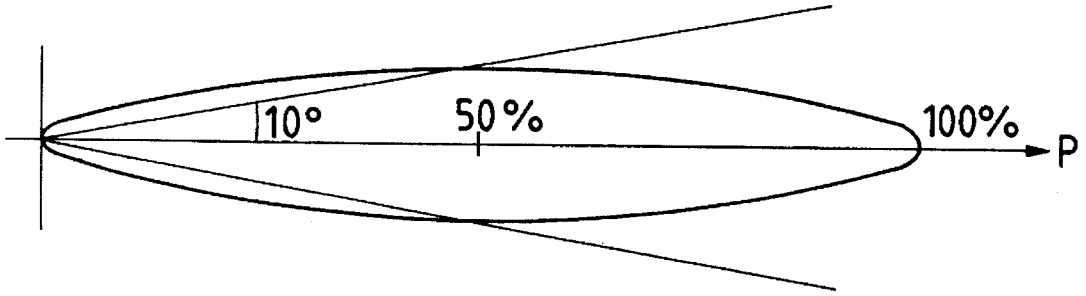
FIG. 4 is a diagram showing a half-value angle of a light emitting device used in the light scattering type smoke sensor according to the invention.

It is preferable that the light emitting device 12 accommodated in the holder 10 is a device having a so-called half-value angle θ1 of substantially 10° or less as shown in FIGS. 3 and 4. A half-value angle means an angle at which the output power P is reduced to a half value. In the light emitting device 12, preferably, its front end is formed by an epoxy lens 12*a* or the like so that light radiated by a tip 12*b* is converged, thereby attaining the half-value angle θ1 of substantially 10° or less.

In order that the viewing field of the light receiving device 13 in the smoke detecting chamber is restricted only to the front area thereof, the labyrinth member 91 which intersects the optical axis of the light emitting device 12 is longer than the other labyrinth members 9, and a gap 20 is formed between the front end of the labyrinth member 91 and the light shielding plate 14. A width of the gap 20, for example, about 3 to 5 mm. All the labyrinth members 9 are structured in such a manner that front end faces 91*a* thereof are not directed to the light emitting face of the light emitting device 12, and the flat portions 91*b* which are reflecting faces for reflecting the light are formed at such an angle that they reflect light radiated by the light emitting device 12 not in the direction toward the light receiving face of the light receiving device 13, but in the direction toward the outside for escape. Namely, each of the labyrinth members 9 has the end face 91*a* at the end adjacent to the smoke detecting chamber, which the face is directed away from the light emitting window 22 of the light emitting device 12, and the flat portions 91*b* reflect the light in a direction opposite to the window 21 of the light receiving device 13.

The labyrinth member 91 intersects the optical axis of the light emitting device 12 at a substantially center portion of the reflecting face of the labyrinth member 91. Preferably, the position of the labyrinth member 91 is adjusted in accordance with the length of the member as follows.

Embodiments of the invention which are applied to the above-described light scattering type smoke sensor will be described.

I) First Embodiment

Figure 5:
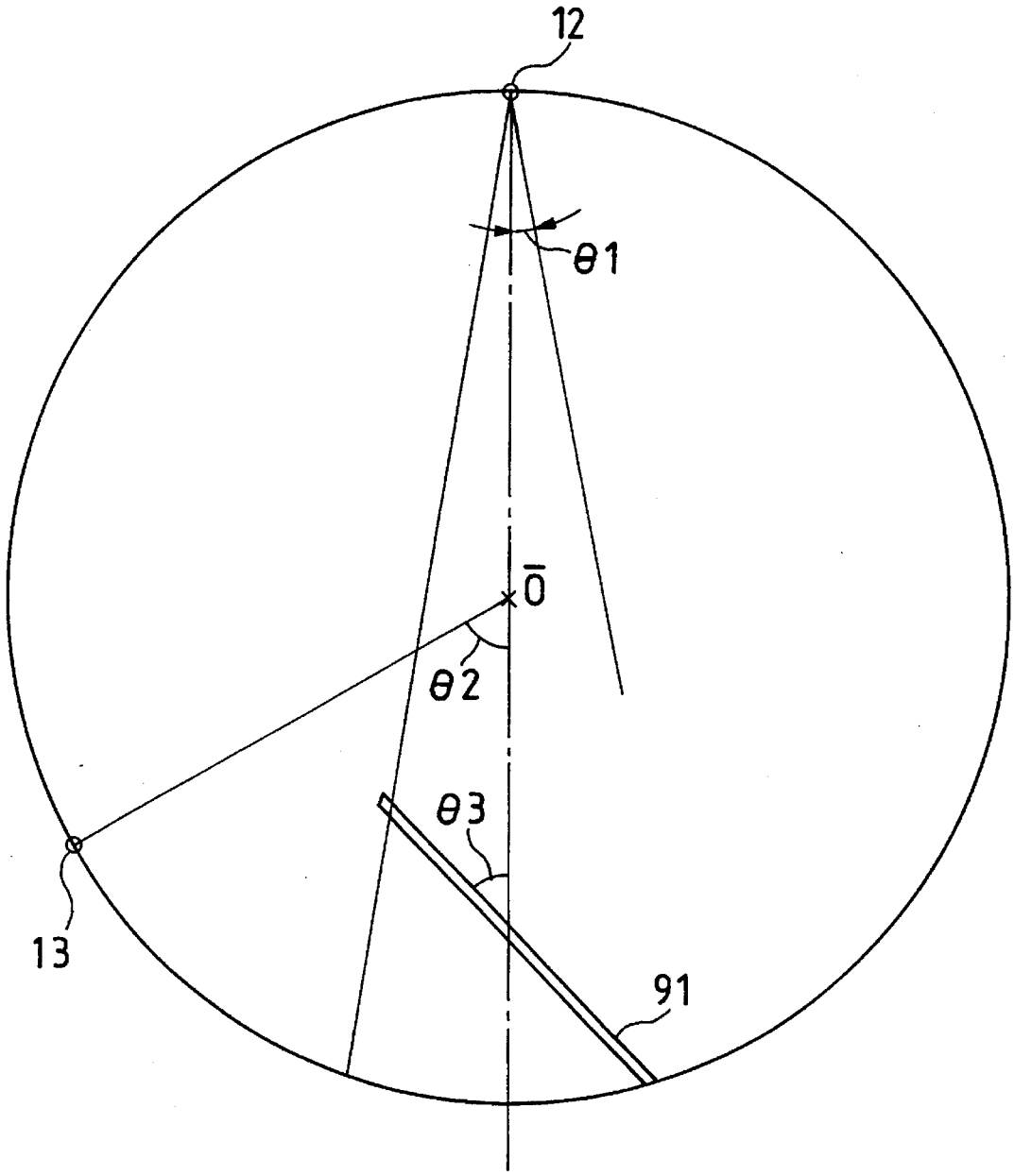
FIG. 5 is a diagram of a first embodiment of the light scattering type smoke sensor according to the invention.

FIG. 5 is a diagram showing a first embodiment of the light scattering type smoke sensor according to the invention.

The light emitting device 12 has a so-called half-value angle θ1 of substantially 10° or less at which the output power P is reduced to a half value. The light emitting device 12, and the light receiving device 13 are disposed in such a manner that a scattering angle θ2 at which their optical axes intersect each other is in the range of substantially 60° to 80°. The labyrinth member 91 which intersects the optical axis of the light emitting device 12 is formed in such a manner that the reflecting face does not face the light receiving face of the light receiving device 13 and forms a reflection angle θ3 of substantially 45° to the optical axis of the light emitting device 12. When an extension face of the labyrinth member 91 which intersects the optical axis of the light emitting device 12 are nearer to the center of the smoke detecting chamber than those of the window 21 of the light receiving face 21 of the light receiving device 13 as shown in FIG. 2(*b*), for example, the reflecting face does not face the light receiving face of the light receiving device 13.

The light emitting device 12, and the light receiving device 13 are disposed in the following manner: The angle at which the optical axes of the devices intersect each other, namely, the scattering angle θ2 is set to be substantially 60° or more so that the light receiving device 13 does not directly receive light emitted by the light emitting device 12, and also to be substantially 80° or less so that the light receiving device 13 does not receive primary reflected light which is reflected by the labyrinth member 91.

Preferably, the above-mentioned angle θ2 formed by the holders 10 and 11 which are shown in FIG. 2 and into which the light emitting device 12 and the light receiving device 13 are to be accommodated is set to be substantially 70°.

The labyrinth members 9 are formed in such a manner that the front end faces 91*a* are not directed to the light emitting face of the light emitting device 12, and at such angles that the flat portions 91*b* do not reflect light radiated by the light emitting device 12 in the direction toward the light receiving face of the light receiving device 13, but reflect the light in the direction toward the outside for escape. In order to reflect light from the light emitting device 12 in the direction opposite to the light receiving device 13, the labyrinth member 91 is preferably formed in such a manner that, for example, the angle θ3 to the optical axis of light emitting device 12 is substantially 45°.

II) Second Embodiment

Figure 6:
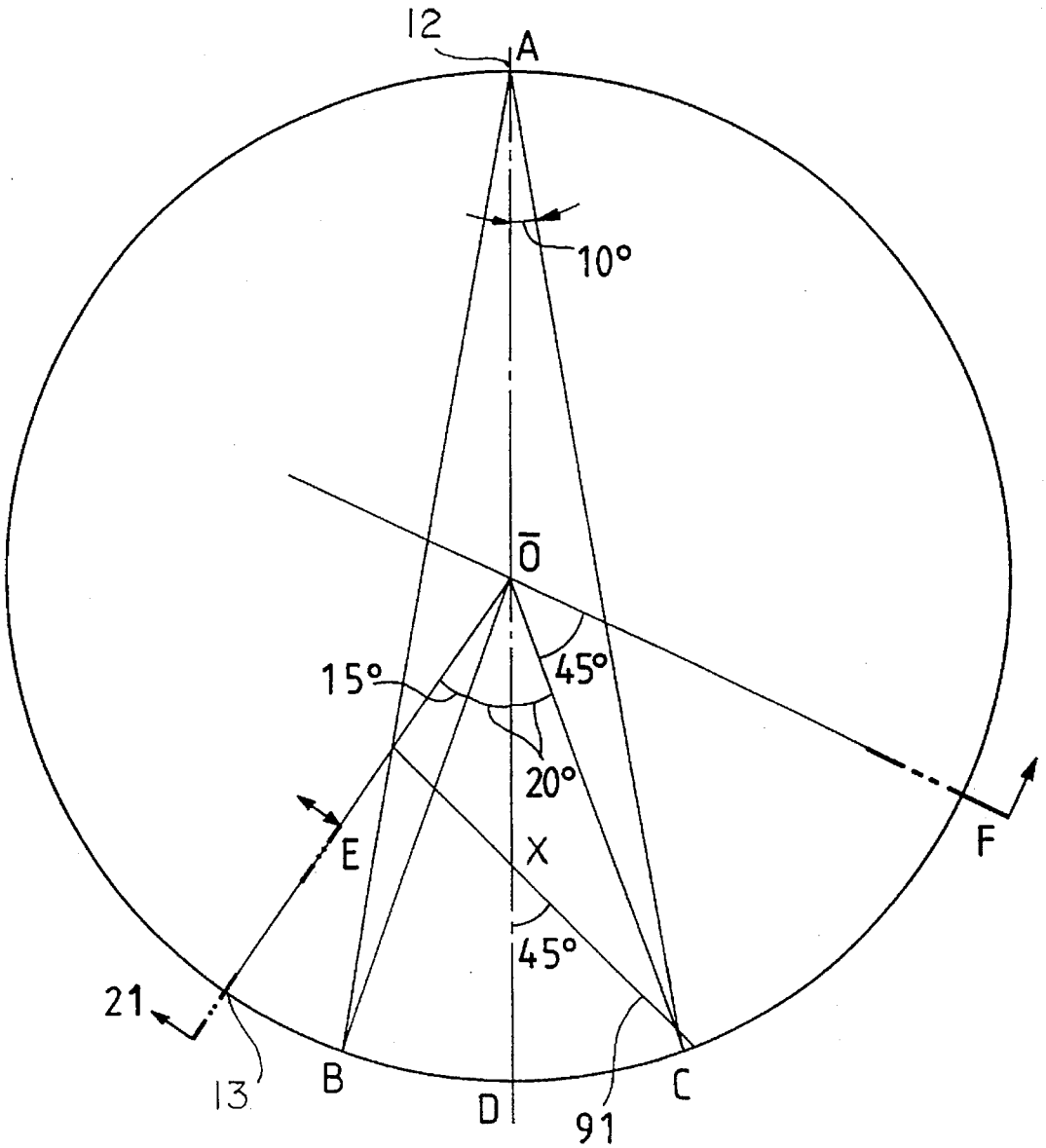
FIG. 6 is a diagram of a second embodiment of the light scattering type smoke sensor according to the invention.

FIG. 6 is a diagram showing a second embodiment of the light scattering type smoke sensor according to the invention. In the figure, positions of components are approximately indicated. In order to facilitate the illustration, the smoke detecting body 2 is formed in a substantially cylindrical shape or has the shape in the horizontal direction which is substantially circular, and the light emitting device 12 is apparently located at a point A on the circle.

In order that the light receiving device 13 does not receive primary reflected light which is reflected by the labyrinth member 91 intersecting the optical axis AD of the light emitting device 12 at a position X, the labyrinth member 91 is formed in such a manner that the reflecting face does not face the light receiving face of the light receiving device 13 and the reflection angle to the optical axis AD of the light emitting device 12 is substantially 45° (angle CXD). Furthermore, the light receiving device 13 is disposed in such a manner that its viewing field does not include an area of the reflecting face of the labyrinth member 91 and passes through a substantially center portion O of the smoke detecting chamber. The labyrinth member 91 intersects the optical axis AD at a substantially center portion of the reflecting face of the labyrinth member 91 (i.e. at point X). The position of the labyrinth member 91 has to be adjusted in accordance with the length of the member.

As shown in FIG. 6, if the labyrinth member 91 was removed, the light emitted from the light emitting device 12 would form a projected plane BC on the inner wall of the smoke detecting body 2 which is opposite to the light emitting device 12. Specifically, one end of the projected plane BC is located at a position B, and the other end of the projected plane BC is located at a position C.

The light receiving device 13 is configured so as to have a viewing field angle of substantially 20° or less. Furthermore, the window 21 of the light receiving device 13 has a certain width in the horizontal dimension. One end of the window 21 is located at a position E, and the other end of the window 21 is located closer to the light emitting device 12. In order not to directly receive light from the light emitting device 12, the one end of the window 21 located at the position E of the light receiving device 13 is separated by substantially 15° (angle BOE) or more from one end B (which is in the direction opposite to the reflection direction of the labyrinth member 91) of the projected plane BC. In order not to receive secondary reflected light which reflected by the labyrinth member 91 and is then reflected by another labyrinth member, the light receiving device 13 is disposed in such a manner that one end of the viewing field (located at a position F) of the light receiving device 13 is separated by substantially 45° (angle COF) or more from the other end C of the side (which is in the reflection direction of the labyrinth member 91) of the projected plane BC.

Figure 7:
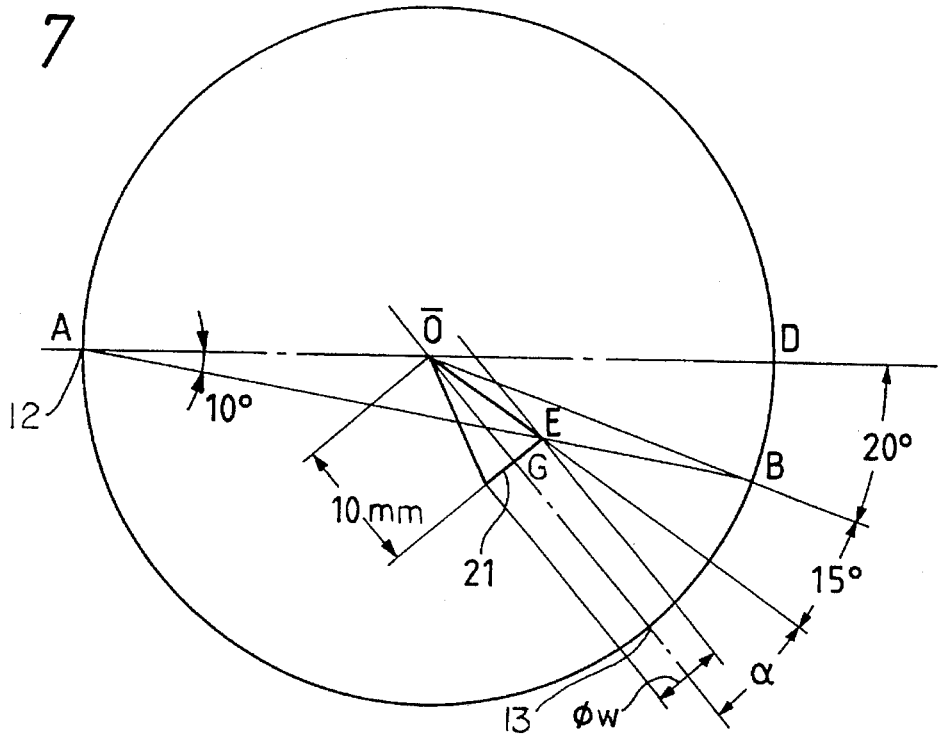
FIG. 7 is a diagram showing the relationship between the projected plane projected by a light emitting section and an window of a light receiving section in the second embodiment of the light scattering type smoke sensor according to the invention.

Next, the range of the scattering angle will be described with reference to FIGS. 7 and 8. When a device having a so-called half-value angle θ1 of 10° at which the output power P is reduced to a half value is used as the light emitting device 12 as shown in FIG. 7, the angle BOD subtended at the center O by an plane BD which is a half of the projected plane BC is 20°. As described above, in order that the light receiving device 13 does not directly receive light from the light emitting device 12, one end E of the window 21 of the light receiving device 13 is located at the position E. The position E is separated from the one end B of the projected plane BC by substantially 15° (angle BOE). (In addition, since the one end E of the window 21 is 15° or more from the one end B of the projection plane BC, the center of the window 21 is 15°+α (angle BOG) from the one end B of the projection plane BC. The light receiving device 13 is disposed so as not to see the reflecting face of the labyrinth member 91. In other words, in the same manner as Embodiment 1, the labyrinth member 91 which intersects the optical axis AD of the light emitting device 12 is disposed in such a manner that the reflecting face does not face the light receiving face of the light receiving device 13.

When the optical axis OG of the light receiving device 13 passes through the center O of the smoke detecting chamber so as not to include an area of the reflecting face of the labyrinth member 91, the diameter ϕ of the smoke detecting chamber is 50 mm, the window 21 is separated from the smoke detecting chamber center O by a distance of 10 mm (OG), and the diameter ϕ of the window is 5 mm, the angle α (angle GOE) subtended at the smoke detecting chamber center O by the area between optical axis OG of the light receiving device 13 and the one end E of the window 21 is as follows:

$$\alpha \text{ (angle GOE)}=\tan^{-1}\text{ (GE/OG) } \alpha=\tan^{-1}\text{ (2.5 mm/10 mm)}\approx 15°$$

where OG is the distance between the center of the smoke detecting chamber and the window 21 and where GE is half of the diameter $\phi_w$ of the window 21.

Therefore, the minimum scattering angle θ formed by the optical axis OD of the light emitting device 12 and the optical axis OG of the light receiving device 13 is obtained from the following expression:

$$\theta \text{ (angle DOG)}=20° \text{ (angle DOB)}+15° \text{ (angle BOE)}+15° \text{ (angle EOG)}=50° \quad (1)$$

with the result of θ>50°.

Figure 8:
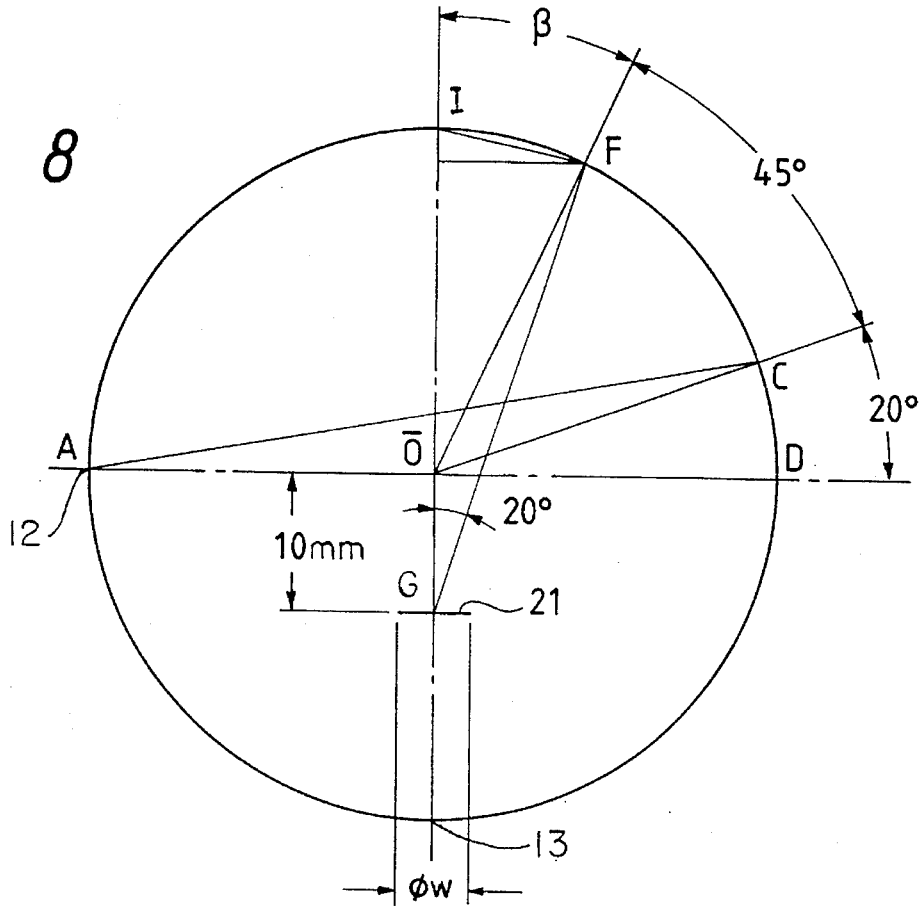
FIG. 8 is a diagram showing the relationship between the projected plane projected by the light emitting section and a viewing field of the light receiving section in the second embodiment of the light scattering type smoke sensor according to the invention.

In order that the light receiving device 13 does not receive secondary reflected light due to the labyrinth members other than the labyrinth member 91, the light emitting device 12 and the light receiving device 13 are disposed in such a manner that, as shown in FIG. 8, the viewing field of the light receiving device 13 is located at the position F which is separated by substantially 45° or more (in the figure, 45°+β) from the other end C of the projected plane BC of the light emitting device 12. When the viewing field angle of the light receiving device 13 is 20° (angle FGI) as shown in FIG. 8, the angle β (angle FOI) subtended at the smoke detecting chamber center O by the area between the optical axis OG of the light receiving device 13 and the position F which is separated by 45° from the other end C of the projected plane BC is obtained as follows:

$$\sin\beta \text{ (angle FOI)}=(FI)/(OI)=(FI)/(25 \text{ mm})$$

$$\sin 20° \text{ (angle FGI)}=(FI)/(GO+OI)=(FI)/(25 \text{ mm}+10 \text{ mm})$$

$$(25+10)\sin 20°=FI$$

$$(25)\sin\beta=FI$$

$$25\sin\beta=(25+10)\sin 20°$$

$$\therefore \beta=28°\approx 25°$$

Therefore, the scattering angle θ in this case is obtained from the following expression:

$$\theta=180° \text{ (angle IOG)}-(20° \text{ (angle DOC)}+45° \text{ (angle COF)}+25° \text{ (angle FOI))}=90° \quad (2)$$

with the result of θ<90°. From Exs. (1) and (2), 50°<θ90°. According to the above-described configuration, consequently, the condition of 50°<scattering angle θ<90° which is considered to be appropriate for detecting light scattered by smoke is attained, and moreover the condition of scattering angle θ≈70° which is considered to be most appropriate is attained.

III) Third Embodiment

Figure 9:
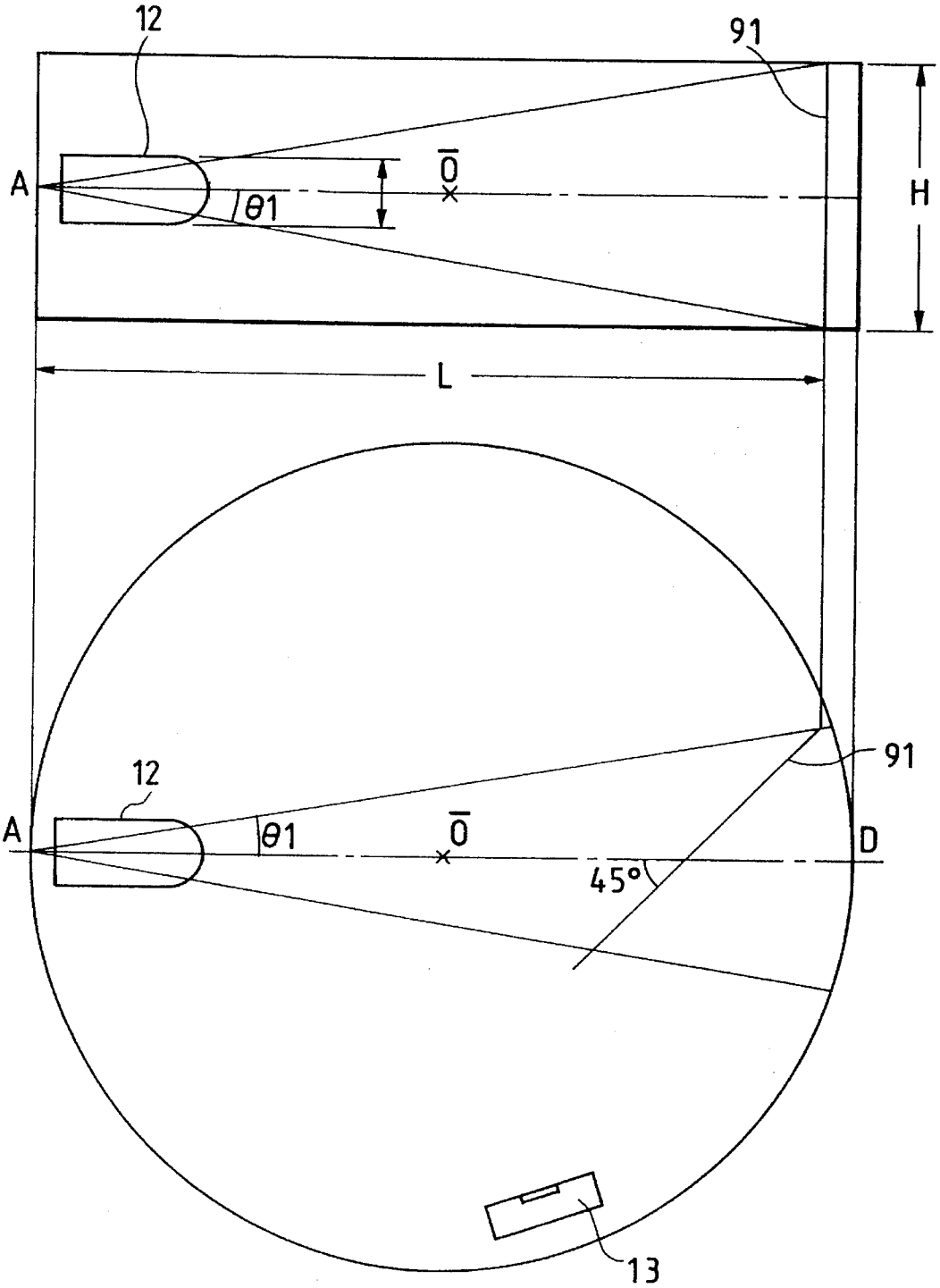
FIG. 9 is a diagram of a third embodiment of the light scattering type smoke sensor according to the invention.

FIG. 9 is a diagram showing a side view and a plan view of a third embodiment of the light scattering type smoke sensor according to the invention. In the figure, positions of components are approximately indicated.

In order to facilitate the illustration, the smoke detecting body 2 is formed in a substantially cylindrical shape or has the shape in the horizontal direction which is substantially circular, and the light emitting device 12 is apparently located at a point A on the circle. The light emitting device 12 located at the point A, and the labyrinth member 91 which intersects the optical axis of the light emitting device 12 are disposed in such a manner that the projecting area (θ1 in the figure) of the light emitting device 12 is within the height H (i.e., the height of the interior of the smoke detecting chamber) of the face of the labyrinth member 91. In this case, the projecting area means an area of the inside of the half value angle. Specifically, the height H of the labyrinth member 91 is substantially 20 mm or less. In this case, the projecting area means an area of the inside of the half value angle.

Regarding the horizontal direction, in order that the light receiving device 13 does not receive primary reflected light due to the labyrinth member 91 which intersects the optical axis AD of the light emitting device 12, the labyrinth member 91 is formed in such a manner that the reflecting face does not face the light receiving face of the light receiving device 13 and forms a reflection angle of substantially 45° to the optical axis AD of the light emitting device 12. In the same manner as Embodiment 1, the light receiving device 13 is disposed in such a manner that its viewing field does not include the reflecting face of the labyrinth member 91 and passes a substantially center portion O of the smoke detecting chamber. The light receiving device 13 is disposed so as not to receive direct light from the light emitting device 12 and also secondary reflected light which is reflected by the labyrinth member 91 and is then reflected by another labyrinth member.

In the embodiment, when the distance between the apparent position A of the light emitting device 12 and the remotest position of the reflecting face of the labyrinth member 91 is indicated by L, and the height of the labyrinth member 91 is indicated by H, the embodiment is so configured that a so-called half-value angle θ1 at which the output power P of the light receiving device 13 is reduced to a half value becomes as follows:

$$\theta 1<\tan^{-1} H/2L$$

In a thin smoke sensor in which the height H of the interior of the smoke detecting chamber is 20 mm or less, the light emitting device 12 of θ1<10° is selected in consideration of variation in an assembling process.

According to this configuration, direct light from the light emitting device 12 is reflected only by the labyrinth member 91 and is not reflected by the ceiling face and the bottom face (the face opposite to the ceiling face) of the smoke detecting chamber, and therefore the zero-point level can be lowered.

IV) Fourth Embodiment

Figure 10:
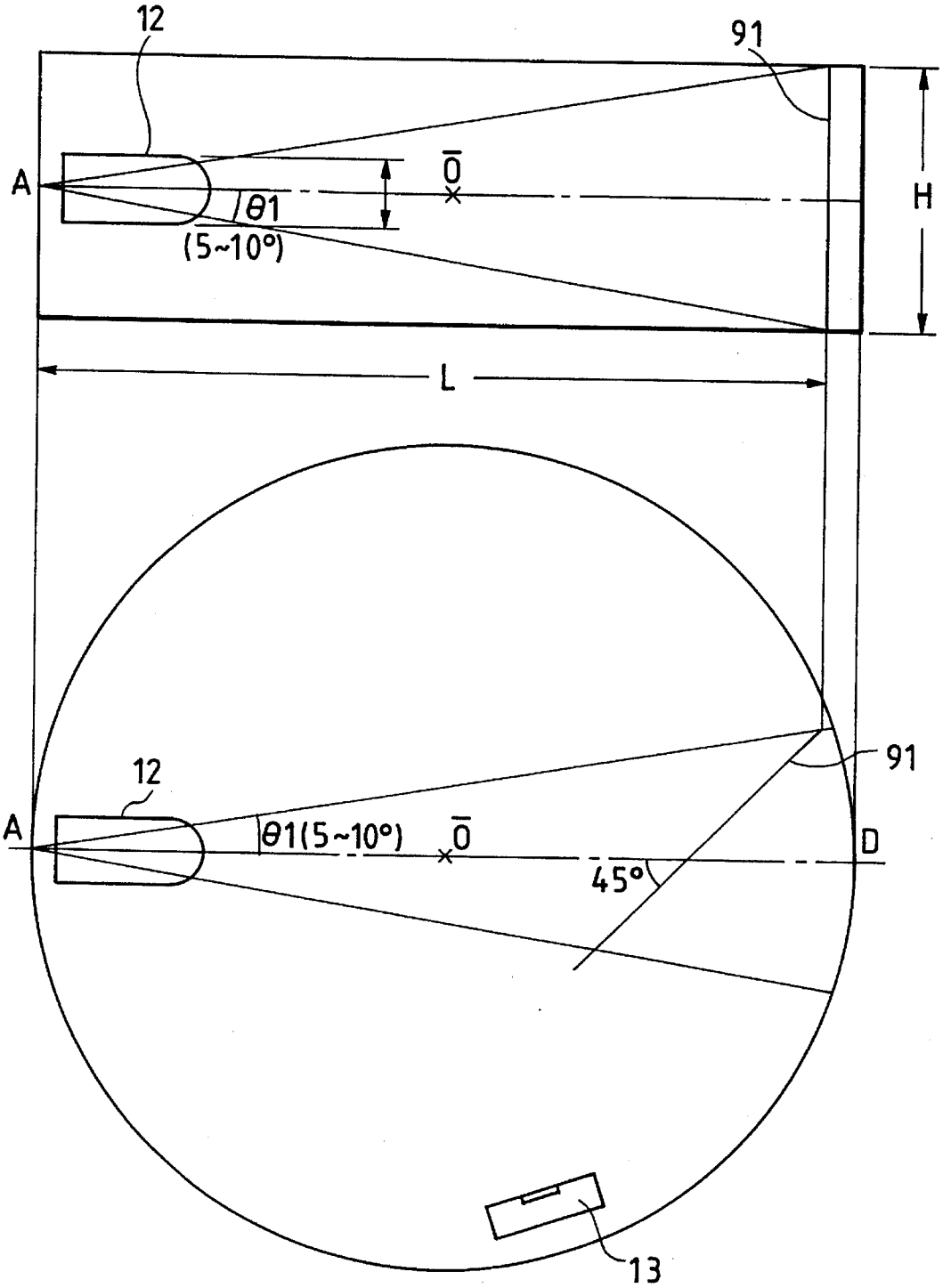
FIG. 10 is a diagram of a fourth embodiment of the light scattering type smoke sensor according to the invention.

FIG. 10 is a diagram showing a side view and a plan view of a fourth embodiment of the light scattering type smoke sensor according to the invention. In the figure, positions of components are approximately indicated. In order to facilitate the illustration, the smoke detecting body 2 is formed in a substantially cylindrical shape or has the shape in the horizontal direction which is substantially circular, and the light emitting device 12 is apparently located at a point A on the circle. The light emitting device 12 located at the point A is disposed in such a manner that a so-called half-value angle θ1 at which the output power P is reduced to a half value is substantially 5° to 10° and the radiation range is within the height H (i.e., the height of the interior of the smoke detecting chamber) of the face of the labyrinth member 91 which intersects the optical axis of the light emitting device 12. Specifically, the height H of the labyrinth member 91 is substantially 20 mm or less.

Regarding the horizontal direction, in order that the light receiving device 13 does not receive primary reflected light due to the labyrinth member 91 which intersects the optical axis of the light emitting device 12, the labyrinth member 91 is formed in such a manner that the reflecting face does not face the light receiving face of the light receiving device 13 and forms a reflection angle of substantially 45° to the optical axis AD of the light emitting device 12. The light receiving device 13 is disposed in such a manner that its viewing field does not see the reflecting face of the labyrinth member 91 and the optical axis passes a substantially center portion O of the smoke detecting chamber which is ahead of the front end of the labyrinth member 91. In the same manner as Embodiment 1, also, the light receiving device 13 is disposed so as not to receive direct light from the light emitting device 12 and secondary reflected light which has been reflected by the labyrinth member 91 and is then reflected by another labyrinth member.

Figure 11:
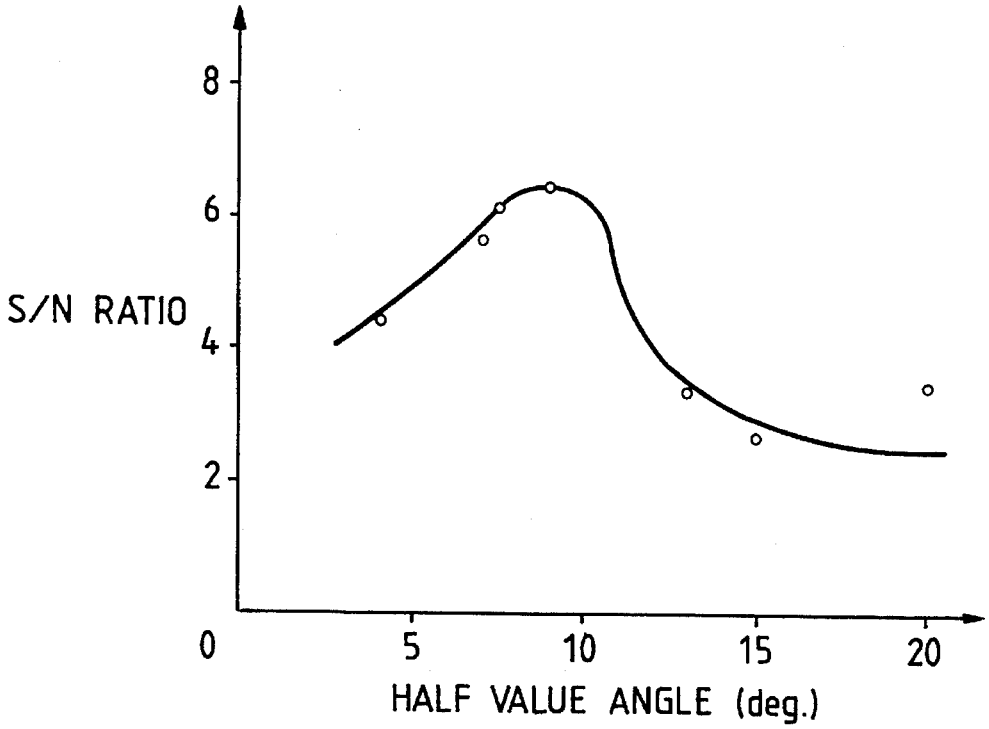
FIG. 11 is a graph showing the relationship between a half-value angle of a light emitting device and an S/N ratio in the light scattering type smoke sensor according to the invention.
Figure 12:
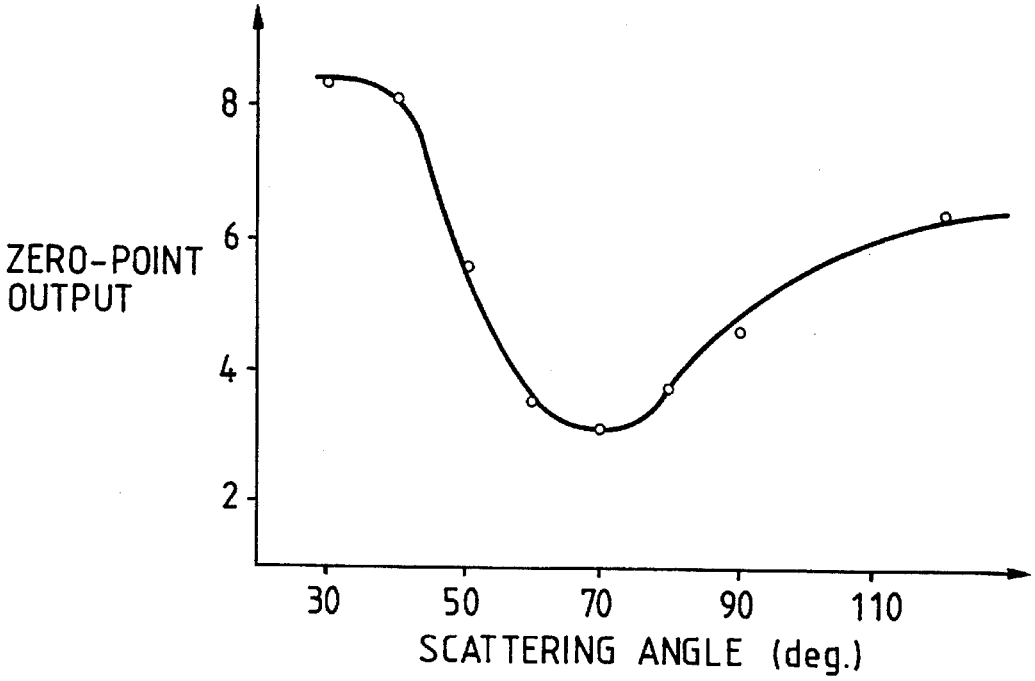
FIG. 12 is a graph showing the relationship between a scattering angle and a zero-point output in the light scattering type smoke sensor according to the invention.

In order to confirm the effect of the above-described embodiment, experiments shown in FIGS. 11 and 12 were conducted.

FIG. 11 shows experimental data obtained in measurements in which light emitting devices respectively having half-value angles θ1 of 4°, 7°, 7.5°, 9°, 13°, 15°, and 20° were used to measure their S/N ratios. As seen from the figure, the S/N ratio increases as the half-value angle θ1 increases to 9°, and decreases as the half-value angle θ1 further increases beyond 9°. Since a device having a half-value angle θ1 of substantially 10° or less is used as the light emitting device 12, it is possible to improve the S/N ratio.

Even when the accuracy of attaching the light emitting device 12 to the holder 10 is low or the optical axis is deviated by variation of the light emitting device 12 itself, the output power of the light emitting device 12 can be set within the viewing field of the light receiving device 13, and the level of an output due to smoke is higher than that obtained in the case where a light emitting device having a large directional angle is used. Since the sensor is not required to incorporate a lens or the like, the sensor can be produced at a lower cost, and the deviation of a light beam which depends on the assembling accuracy of a light emitting device and a lens does not occur.

FIG. 12 shows zero-point outputs obtained in the case where the light emitting device 12 having a half-value angle θ1 of 9° and the scattering angle θ2 or the angle at which the optical axes of the light emitting device 12 and the light receiving device 13 intersect each other is changed from 30° to 90° in the step of 10° and to 120°. As seen from the figure, the zero-point output decreases as the scattering angle θ2 increases from 30° to 70° and increases as the angle further increases beyond 70°.

As described above, the scattering angle θ2 is in the range of 60° to 80°, the labyrinth member 91 which intersects the optical axis of the light emitting device 12 is formed so as to reflect light from the light emitting device 12 in the direction opposite to the light receiving device 13, and the light receiving device 13 does not receive primary reflected light due to the labyrinth member 91. Therefore, it is possible to lower the zero-point level. The zero-point level means an output of the light receiving device obtained when there is no smoke in the smoke detecting chamber. If the light receiving device easily receives reflected light when there is no smoke in the smoke detecting chamber, the zero-point level is naturally increased so that it is difficult to conduct the judgment on fire and normal states.

Even when light emitted from the light emitting device 12 for detecting smoke is reflected several times by the flat portions 91*b* and front end edges of the labyrinth member 9 so as to be diffused in the smoke detecting chamber, the light receiving device 13 is shielded from the diffused light by the labyrinth member 91 and the light shielding plate 14. In addition, the viewing field of the light receiving device 13 is formed by the gap 20 and the window 21, so that the area of the viewing field is relatively small. Accordingly, it is possible to lower the zero-point level of the detection output of the light receiving device 13.

As a result, the S/N ratio can be improved, and hence the reliability can be enhanced. In addition, it is possible to provide a sufficient margin for various noises such as dust or dew formation. Furthermore, since the area which receives reflected light in the smoke detecting chamber is limited, it is sufficient to put emphasis on the design of the labyrinth structure in the light receiving area. Thus, it becomes possible to increase the degree of freedom of the design of the labyrinth structure against the inflow of smoke and the optical disturbance.

As described above, in the first embodiment, the light emitting device has a so-called half-value angle θ1 of substantially 10° or less, the light emitting section, and the light receiving section are disposed in such a manner that a scattering angle at which their optical axes intersect each other is in the range of substantially 60° to 80°, and the reflecting face of the labyrinth member which intersects the optical axis of the light emitting section does not face the light receiving face of the light receiving section. Even when the accuracy of assembling the light emitting device and the light receiving device is low or the optical axis is deviated by variation of the light emitting device itself, a thinned structure does not cause a part of direct light from the light emitting section and light reflected by the labyrinth members to enter the light receiving section. Therefore, the zero-point level can be lowered by a simple structure.

In the second embodiment, the labyrinth member which intersects the optical axis of the light emitting section is disposed in such a manner that its reflecting face intersects the optical axis of the light receiving section at substantially 45°, and the light receiving section is disposed in such a manner that its viewing field does not include an area of the reflecting face of the labyrinth member which intersects the optical axis of the light emitting section, and passes a substantially center portion of the smoke detecting chamber. Therefore, the light receiving section is prevented from receiving primary reflected light due to the labyrinth member which intersects the optical axis of the light emitting section, whereby the zero-point level of the detection output of the light receiving section can be reduced to a level as low as possible.

Moreover, the window of the light receiving section is located at a position which is separated by substantially 15° or more from one end of the light receiving section side of the projected plane which is projected by the light emitted from emitting section for the labyrinth member which intersects the optical axis of the light emitting section, and the viewing field of the light receiving section is disposed at a position which is separated by substantially 45° or more from the projected plane projected by the light emitting section in the reflection direction of the labyrinth member. Therefore, the light receiving section is prevented from receiving direct light from the light emitting section and also secondary reflected light which has been reflected by the labyrinth member confronting the light emitting face of the light emitting section, and which is then reflected by another labyrinth member. Consequently, the zero-point level of the detection output of the light receiving section can be reduced to a level as low as possible.

In the third embodiment, the projecting area of the light emitting section is disposed so as to be within the height of the face of the labyrinth member which intersects the optical axis of the light emitting section. Regarding the vertical direction, therefore, direct light from the light emitting device is reflected only by the labyrinth member which intersects the optical axis of the light emitting section, and is not reflected by the ceiling face and the bottom face of the smoke detecting chamber, whereby the zero-point level can be lowered.

In the fourth embodiment, a light scattering type smoke sensor in which the height of the smoke detecting chamber is 20 mm or less is configured so that a half-value angle of the light emitting device is substantially 5° to 10°. Even when the sensor is to be thinned, therefore, the sensor is easily configured in such a manner that direct light from the light emitting device is reflected only by the labyrinth member which intersects the optical axis of the light emitting section, and is not reflected by the ceiling face and the bottom face of the smoke detecting chamber. Therefore, the zero-point level can be lowered.

What is claimed is:

1. A light scattering type smoke sensor comprising:

a plurality of labyrinth members for facilitating an inflow of smoke entering from outside, and for cutting off light entering from the outside;

a smoke detecting chamber which is formed in a center portion by said labyrinth members;

light emitting means for radiating light toward said smoke detecting chamber; and light receiving means for detecting light scattered by said smoke in said smoke detecting chamber, said light receiving means having an optical axis which intersects in said smoke detecting chamber an optical axis of said light emitting means at a scattering angle in a range of substantially 60° to 80°, wherein one of said labyrinth members intersects said optical axis of said light emitting means, which has a reflecting face for reflecting light radiated from said light emitting means, said reflecting face reflecting said light in a direction opposite to said light receiving means, wherein any points of an extension face of said labyrinth member which intersects said optical axis of said light emitting means are nearer to a center of said smoke detecting chamber than those of a light receiving window of said light receiving means, and wherein said light receiving means includes said light receiving window, a light receiving device, and a holder which defines a position of said light receiving window and secures said light receiving device.

2. A light scattering type smoke sensor according to claim 1, wherein said light emitting means has a half-value angle which is greater than 0° and less than or equal to 10°.

3. A light scattering type smoke sensor according to claim 1, wherein said one of said labyrinth members intersects said optical axis of said light emitting means at a substantially center portion of said reflecting face of said labyrinth member.

4. A light scattering type smoke sensor according to claim 1, wherein said reflecting face of said labyrinth member which intersects said optical axis of said light emitting means intersects said optical axis of said light emitting means at substantially 45°.

5. A light scattering type smoke sensor according to claim 1, wherein at least one of said labyrinth members has a front end face adjacent to said smoke detecting chamber, which said face is directed away from a light emitting window of said light emitting means.

6. A light scattering type smoke sensor according to claim 1, wherein said labyrinth member which intersects said optical axis is longer than other labyrinth members which are adjacent to said labyrinth member.

7. A light scattering type smoke sensor comprising:

a plurality of labyrinth members for facilitating an inflow of smoke entering from outside, and for cutting off light entering from the outside;

a smoke detecting chamber which is formed in a center portion by said labyrinth members;

light emitting means for radiating light toward said smoke detecting chamber; and light receiving means for detecting light scattered by said smoke in said smoke detecting chamber, said light receiving means having an optical axis which intersects in said smoke detecting chamber an optical axis of said light emitting means, wherein one of said labyrinth members intersects said optical axis of said light emitting means at substantially 45° at a substantially center of a reflecting face of said labyrinth member, a viewing field of said light receiving means excluding an area of a reflecting face of said labyrinth member which intersects said optical axis of said light emitting means, and passing a substantially center portion of said smoke detecting chamber, and wherein any points of an extension face of said labyrinth member which intersects said optical axis of said light emitting means are nearer to a center of said smoke detecting chamber than those of a light receiving window of said light receiving means, and wherein said light receiving means includes said light receiving window, a light receiving device, and a holder which defines a position of said light receiving window and secures said light receiving device.

8. A light scattering type smoke sensor according to claim 7, wherein said light emitting means has a half-value angle which is greater than 0° and less than or equal to 10°.

9. A light scattering type smoke sensor according to claim 7, wherein said light receiving means has a viewing field angle in a range of substantially 0° to 20°.

10. A light scattering type smoke sensor according to claim 7, wherein said light receiving means has a light receiving window, said receiving window being disposed at a position which is separated from one end of the light receiving means side of a projected plane projected by said light emitting means by an angle substantially in a range of 15° to 360°, and the viewing field of said light receiving means is disposed at a position which is separated by substantially 45° or more from another end of said projected plane.

11. A light scattering type smoke sensor according to claim 10, wherein said light emitting means has a half-value angle which is greater than 0° and less than or equal to 10°.

12. A light scattering type smoke sensor according to claim 10, wherein said light receiving means has a field angle in a range of substantially 0° to 20°.

13. A light scattering type smoke sensor according to claim 7, wherein only said labyrinth member which intersects said optical axis reflects direct light from said light emitting means.

14. A light scattering type smoke sensor according to claim 7, wherein said labyrinth member which intersects said optical axis is longer than other labyrinth members which are adjacent to said labyrinth member.

15. A light scattering type smoke sensor comprising:

a plurality of labyrinth members for facilitating an inflow of smoke entering from outside said smoke sensor, and for cutting off light entering from the outside;

a smoke detecting chamber which is formed in a center portion of said smoke sensor by said labyrinth members;

light emitting means in said smoke sensor for radiating a light beam toward said smoke detecting chamber;

light receiving means for detecting light scattered by said smoke in said smoke detecting chamber, said light receiving means having an optical axis which intersects in said smoke detecting chamber an optical axis of said light emitting means; and a projecting area, wherein said projecting area is an inside area of a half value angle of said light beam, wherein a face of one of said plurality of labyrinth members intersects said optical axis of said light emitting means, and wherein said light beam irradiates said face of said one of said plurality of labyrinth members substantially within a height of said face.

16. A light scattering type smoke sensor according to claim 15, wherein said height of said face of said labyrinth member which intersects said optical axis of said light emitting means is greater than 0° and less than or equal to 20 mm.

17. A light scattering type smoke sensor according to claim 16, wherein said light emitting means has a half-value angle of substantially 5° to 10°.

18. A light scattering type smoke sensor according to claim 15, wherein, when a height of said labyrinth member which intersects said optical axis is indicated by H, and a distance between said light emitting means and a remotest position of a reflecting face of said labyrinth member which intersects said optical axis is indicated by L, a half-value angle θ of said light receiving means satisfies the following expression:

$$\theta<\tan^{-1}H/2L.$$

19. A light scattering type smoke sensor according to claim 15, wherein said labyrinth member which intersects said optical axis is longer than other labyrinth members which are adjacent to said labyrinth member.

20. A light scattering type smoke sensor according to claim 15, wherein a viewing field of said light receiving means passes a substantially center portion of said smoke detecting chamber.

21. A light scattering type smoke sensor according to claim 15, wherein any points of an extension face of said labyrinth member which intersects said optical axis of said light emitting means are nearer to a center of a center of said smoke detecting chamber than those of a window of said light receiving means.

22. A light scattering type smoke sensor according to claim 15, wherein said reflecting face of said labyrinth member which intersects said optical axis of said light emitting means intersects said optical axis of said light emitting means at substantially 45°.

23. A light scattering type smoke sensor according to claim 22, wherein said height of said face of said labyrinth member which intersects said optical axis of said light emitting means is greater than 0° and less than or equal to 20 mm.

24. A light scattering type smoke sensor according to claim 23, wherein said light emitting means has a half-value angle of substantially 5° to 10°.

25. A light scattering type smoke sensor according to claim 23, wherein said labyrinth member which intersects said optical axis is longer than other labyrinth members which are adjacent to said labyrinth member.

26. A light scattering type smoke sensor according to claim 23, wherein a viewing field of said light receiving means passes a substantially center portion of said smoke detecting chamber.

27. A light scattering type smoke sensor comprising:

a plurality of labyrinth members for facilitating an inflow of smoke entering from outside, and for cutting off light entering from the outside;

a smoke detecting chamber which is formed in a center portion by said labyrinth members;

light emitting means for radiating light toward said smoke detecting chamber; and light receiving means for detecting light scattered by said smoke in said smoke detecting chamber, said light receiving means having an optical axis which intersects in said smoke detecting chamber an optical axis of said light emitting means at a scattering angle in a range of substantially 60° to 80°, wherein one of said labyrinth members intersects said optical axis of said light emitting means, which has a reflecting face for reflecting light radiated from said light emitting means, said reflecting face reflecting said light in a direction opposite to said light receiving means, wherein said light emitting means has a half-value angle which is greater than 0° and less than or equal to 10°.

28. A light scattering type smoke sensor comprising:

a plurality of labyrinth members for facilitating an inflow of smoke entering from outside, and for cutting off light entering from the outside;

a smoke detecting chamber which is formed in a center portion by said labyrinth members;

light emitting means for radiating light toward said smoke detecting chamber; and light receiving means for detecting light scattered by said smoke in said smoke detecting chamber, said light receiving means having an optical axis which intersects in said smoke detecting chamber an optical axis of said light emitting means, wherein one of said labyrinth members intersects said optical axis of said light emitting means at substantially 45° at a substantially center of a reflecting face of said labyrinth member, a viewing field of said light receiving means excluding an area of a reflecting face of said labyrinth member which intersects said optical axis of said light emitting means, and passing a substantially center portion of said smoke detecting chamber, wherein said light emitting means has a half-value angle which is greater than 0° and less than or equal to 10°.

* * * * *